United States Patent [19]

Mazabras

[11] 4,245,407

[45] Jan. 20, 1981

[54] ARCH AND HEEL ASSEMBLY FOR SHOES

[75] Inventor: Jean Mazabras, Romans, France

[73] Assignee: Societe des Chaussures Seducta Charles Jourdan & Fils, Romans, France

[21] Appl. No.: 42,193

[22] Filed: May 24, 1979

[30] Foreign Application Priority Data

Jun. 30, 1978 [FR] France ..... 78 19627

[51] Int. Cl.[3] ..... A43B 13/28; A43B 21/00

[52] U.S. Cl. ..... 36/24.5; 36/34 R; 36/11.5; D2/325

[58] Field of Search ..... 36/24.5, 34 R, 34 A, 36/11.5, 91, 106; D2/324, 325, 302

[56] References Cited

U.S. PATENT DOCUMENTS

| | | | |
|---|---|---|---|
| D. 121,193 | 6/1940 | Nutt | 36/34 R |
| D. 205,882 | 10/1966 | Post | 36/34 R |
| D. 205,883 | 10/1966 | Post | 36/34 R |
| 2,234,066 | 3/1961 | Winkel et al. | 36/106 |
| 3,262,221 | 7/1966 | Antelo | 36/34 R |

FOREIGN PATENT DOCUMENTS

| | | | |
|---|---|---|---|
| 1118579 | 3/1956 | France | 36/34 R |
| 1476115 | 2/1967 | France | 36/24.5 |
| 668034 | 7/1964 | Italy | 36/34 R |

*Primary Examiner*—James Kee Chi

*Attorney, Agent, or Firm*—Henry R. Lerner

[57] ABSTRACT

An arch and heel assembly for shoes having an arch and a heel secured to each other at their upper ends. A connecting link has its front end secured to the base of the arch and its rear end secured to the base of the heel to define a substantially triangular open area between the arch, the heel and the connecting link.

9 Claims, 7 Drawing Figures

ARCH AND HEEL ASSEMBLY FOR SHOES

This invention relates to an arch and heel assembly for use in the manufacture of shoes.

The typical shoe has an arch intended for supporting the ball and the heel of the foot. The base of this arch is connected to the sole of the shoe, whereas the top of the arch is supported in raised condition by a heel. In arch and heel assemblies the connection of the heel to the arch is achieved either by fixing the heel onto the arch or by molding the assembly in a single piece, as for example from a synthetic material.

The narrower and higher the heel is, the stronger the junction of the heel to the arch must be.

In order to improve the strength of the junction of the heel to the arch, it is possible either to use stronger means of fixation or materials, or to make a heel that widens towards the top so as to increase the connecting surface between the heel and the arch. The main drawback of these solutions is that they add to manufacturing costs while not being able with certainty to prevent all danger of accidental breakage of the connection.

The present invention is aimed at avoiding these drawbacks by offering an arch and heel assembly in which the junction of the heel to the arch is especially resistant, even in cases in which this junction is thin and delicate.

This problem is solved in accordance with the invention by having an arch and heel assembly which includes a connecting link, the front extremity of which is connected to the base of the arch and the back extremity of which is connected to the base of the heel, thus defining a substantially triangular zone between the heel, the arch and the connecting link.

In accordance with a preferred embodiment of the invention, the arch and the heel are molded in a single piece and the connecting link is joined to the arch and the heel. In this way it is possible to avoid the presence of a visible line of junction, which one would have if the arch, the heel and the connecting link were all molded in a single piece, as is equally possible.

In accordance with a particular feature of the invention, the front extremity of the connecting link is provided with nipples or lugs which can be introduced and riveted, as for example in a hot process, into corresponding apertures provided in the base of the arch.

However, the joining of the front extremity of the connecting link with the base of the arch can likewise be achieved by using rivets going through both the connecting link and the arch.

In accordance with another particular feature of the invention, the rear extremity of the connecting link is fitted into the base of the heel.

This type of assembling is advantageously achieved by virtue of the fact that the rear extremity of the connecting link is provided with a stud united by a bridge of material to the connecting link and suitable for being introduced lengthwise into a complementarily shaped slot provided at the base of the heel.

In accordance with this embodiment, it is particularly advantageous for the height of the stud to be less than the depth of the slot in the heel, so that, after the stud has been introduced into the slot, a hollow space remains at the base of the heel, suitable for receiving the projecting portion of a top lift.

The fixation of the top lift and the connecting link onto the heel is then preferably effected by means of a pin which passes successively through an orifice in the top lift and an orifice in the stud and is anchored in a recessed hole in the heel.

Other characteristics and advantages of the invention will become manifest from a reading of the description which follows in connection with an example given without limitation of an arch and heel assembly made in accordance with the invention, while referring to the annexed drawings, in which.

Figure 1:
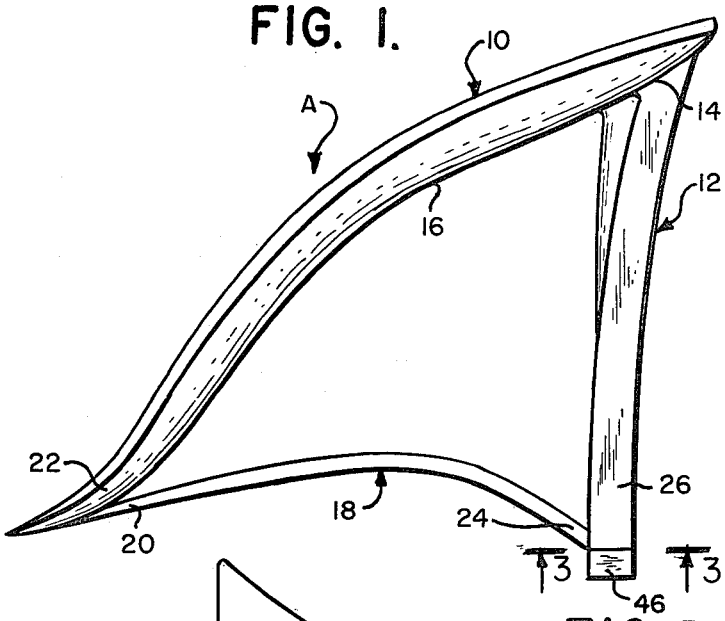
FIG. 1 is a side view of an arch and heel assembly including a connecting link in accordance with the invention.
Figure 3:
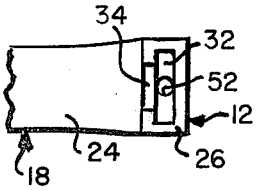
FIG. 3 is a bottom view of the heel and the rear extremity of the connecting link, with the lift not shown, as viewed from line 3—3 in FIG. 1.
Figure 3A:
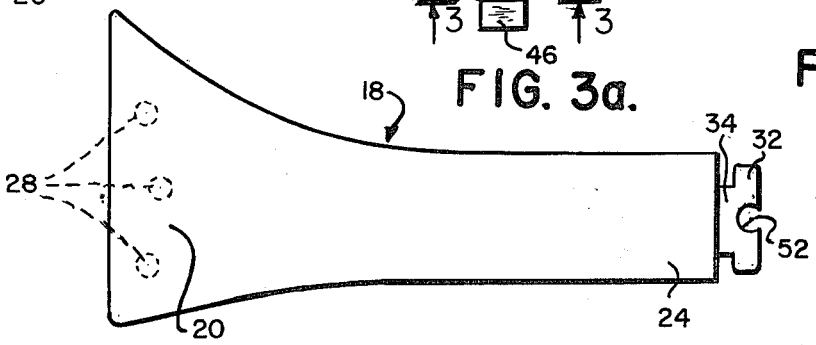
Figure 3B:
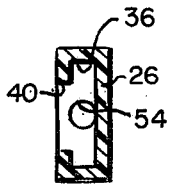
Figure 4:
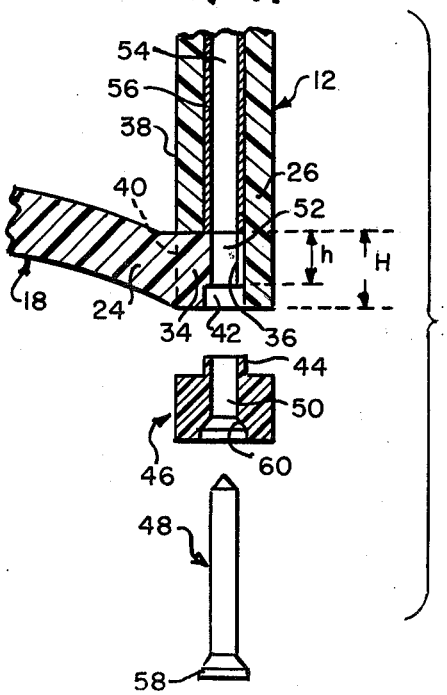
Figure 5:
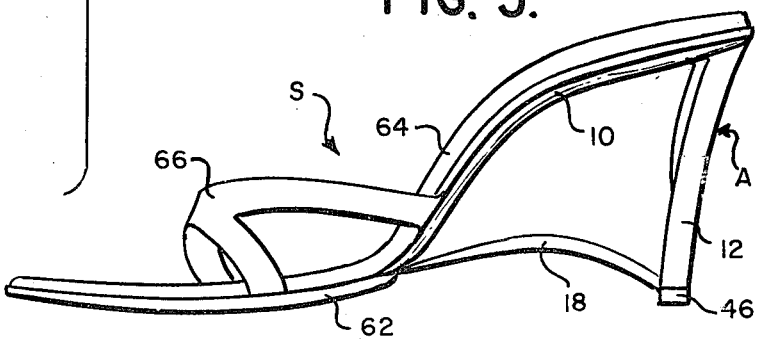

FIG. 3*a* is a bottom view of the connecting link;

FIG. 3*b* is a transverse sectional view at the bottom of the heel;

FIG. 4 is an exploded sectional view through the base of the heel and the rear extremity of the connecting link of the arch and heel assembly in FIG. 1, showing the joining of a top lift to the base of the heel; and FIG. 5 is a side view of a ladies' shoe incorporating the arch heel assembly in accordance with the invention.

Illustrated in FIG. 1 is an arch and heel assembly A comprising an arch 10 and a heel 12 formed of a single piece by molding from a rigid synthetic material, such as, for example, a rigid polyamide. The heel 12 is a high, thin and delicate heel joined at its upper end 14 to the underside 16 of the arch 10.

The arch and heel assembly A in FIG. 1 comprises, in addition, a connecting link 18, the front extremity 20 of which is connected to the base 22 of the arch 10 and the rear extremity 24 of which is connected to the base 26 of the heel 12 so as in this way to define a substantially triangular area between the heel, the arch and the connecting link.

The connecting link 18 is molded of the same material as the arch and heel. This connecting link is curved with the concave side facing bottom so that the front extremity 20 thereof is in tangential relation with the base 22 of arch 10 and the central portion of the connecting link is spaced from the floor when the shoe rests thereon. The width of the front extremity 20 of the connecting link corresponds substantially to the width of the base 22 of the arch 10 and, as shown in FIGS. 3*a* and 3*b*, is greater than the width of the rear extremity 24, which corresponds substantially to the width of the base 26 of the heel.

Figure 2:
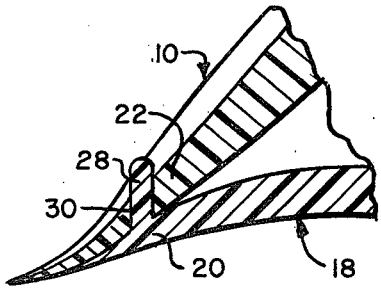
FIG. 2 is a partial view in longitudinal section of the arch and heel assembly in FIG. 1, showing the fixation of the rear extremity of the connecting link onto the arch.

The joining of the front extremity 20 of the connecting link 18 onto the base 22 of the arch 10 is illustrated in detail in FIG. 2. As can be seen in this figure, the extremity 20 is provided with nipples or lugs 28, for example three in number, which pass through corresponding apertures 30 in base 22 of the arch 10. These nipples or lugs are preferably directed vertically for the purpose of enhancing the strength of the joint between the connecting link and the arch. After the nipples or lugs 28 have been inserted into the apertures 30, they are hot riveted in order to ensure a solid bond between the connecting link and the arch.

As a variant, it is possible to replace the nipples 28 with rivets which pass through both the front extremity 20 of the connecting link 18 and the base 22 of the arch 10.

Reference is now made to FIGS. 3, 3*a*, 3*b* and 4 in order to describe the joining of the rear extremity 24 of the connecting link 18 with the base 26 of the heel 12.

The back extremity 24 is encased in the base 26 of the heel 12. For this purpose the back extremity 24 comprises a stud 32 connected by a bridge of material 34 to the connecting link 18. As can be seen in FIGS. 3 and 3*a*, the stud 32 has an oblong shape, the larger dimension of which is intermediate the width of the bridge 34 and the width of the base 26 of the heel 12. For reasons to be more fully described hereafter, stud 32 is provided with an opening 52.

The stud 32 is intended to be inserted longitudinally into a complementarily shaped slot 36 located at the base of the heel. This slot thus has an oblong horizontal section corresponding to that of the slot 32 and the front surface 38 of the base 26 of the heel 12 is provided with an opening 40 communicating with the slot 36 in order to enable the bridge 34 to be received therein.

The height h of the stud 32 is less than the depth H of the slot 36, so that after the stud 32 has been inserted into the slot 36, a recess 42 remains at the base of the heel as best seen in FIG. 4. This recess 42 is designed to accommodate the correspondingly shaped projecting part 44 of a top lift 46 made, for example, of polyurethane.

The joining of the top lift 46 and the connecting link 18 onto the heel 12 is effectuated by means of a pin 48 which passes successively through an aperture 50 in the top lift and opening 52 in the stud 32 and which is secured in a recessed hole 54 in the heel by means of a metal split pin 56 previously inserted into the recessed hole 54. The pin 48 has a beveled head 58 which is concealed inside the top lift 46 due to a countersunk bore 60 provided on the lower surface of the top lift and in axial alignment with the aperture 50.

As a variant, the metal split pin 56 may be eliminated so that the pin 48 is clamped directly in the recessed hole 54.

Once the arch and heel assembly A of the invention has been assembled, it is used in the manufacture of a shoe. As shown in FIG. 5, the arch heel assembly A is incorporated in a shoe S by securing thereto an outer sole 62 and an inner sole 64 which extends over arch 10 and outer sole 62, said inner sole 64 defining the foot supporting surface of the shoe. Depending on the particular style of the shoe, strap 66 or some other arrangement can be used for permitting the user to retain the shoe on the foot.

It will be understood that the provision of arch heel assembly A including the connecting link 18 enables the shoe to have sufficient strength and rigidity even though the heel is a particularly narrow one which would otherwise have a tendency to separate from the shoe upon usage. It will also be understood that while a specific preferred method for securing the connecting link to the arch and the heel has been described, such securement could be provided by molding or by some other known method. Further, while the invention has been described in connection with a shoe having a particularly high heel, it will be understood that the invention is equally applicable to shoes having heels of different heights.

While there is herein shown and described the preferred embodiment of the invention, it will be understood that the invention may be embodied otherwise than as herein specifically illustrated or described, and that in the illustrated embodiment certain changes in the details of construction and in the form and arrangement of parts may be made without departing from the underlying idea or principles of this invention within the scope of the appended claims.

Having thus described my invention, what I claim and desire to secure by letters patent is:

1. An arch and heel assembly for shoes comprising an arch, a heel secured at the upper end thereof to the rear end of said arch, and a connecting link secured at the front end thereof to the base of the arch and at the rear end thereof to the base of said heel whereby to define a substantially triangular open area between said arch, heel and connecting link, the rear end of said link being provided with a stud connected to said link by a bridge, and said heel being provided at its base with a slot complementary to said stud whereby said stud is insertable into said slot.

2. An assembly in accordance with claim 1, wherein the arch and the heel are formed of a single piece.

3. An assembly in accordance with claim 1, wherein the front end of the connecting link is provided with nipples insertable and rivetable into complementary apertures in the base of the arch.

4. An assembly in accordance with claim 1, wherein the depth of said slot is greater than the depth of said stud whereby to define a recess in said slot after said stud has been inserted therein, said recess being adapted for receiving the projecting portion of a lift.

5. An assembly in accordance with claim 4, wherein there is provided a pin adapted to pass successively through an aperture in said lift, an aperture in said stud and a recessed hole in said heel for securing the lift and the connecting link onto the heel.

6. An assembly in accordance with claim 5, wherein said pin is secured inside said recessed hole by a split pin provided therein.

7. An assembly in accordance with claims 1, 2, 3, 4, 5 or 6, wherein said connecting link is a curved strip whose concave side faces downwardly whereby said connecting link is in spaced relation with the walking surface for said shoe.

8. An assembly in accordance with claim 7, wherein the front end of the connecting link is wider than its rear end, and wherein said front end is secured in tangential relation to the base of said arch.

9. A shoe comprising an arch heel assembly in accordance with claims 1, 2, 3, 4, 5, 6, or 8.

* * * * *